United States Patent [19]

Dideriksen et al.

[11] 4,028,844

[45] June 14, 1977

[54] TOY BUILDING BLOCK FOR SUPPLEMENTING EXISTING BLOCK SETS

[75] Inventors: Erling Thue Dideriksen; Jens Nygaard Knudsen, both of Billund, Denmark

[73] Assignee: Interlego A.G., Switzerland

[22] Filed: May 17, 1976

[21] Appl. No.: 687,218

[30] Foreign Application Priority Data

May 23, 1975 Denmark ..... 2288/75

[52] U.S. Cl. ..... 46/22; 46/25

[51] Int. Cl.[2] ..... A63H 33/08

[58] Field of Search ..... 46/24, 25, 16, 22

[56] References Cited

UNITED STATES PATENTS

| | | | |
|---|---|---|---|
| 1,209,440 | 12/1916 | Humbert | 46/16 |
| 2,649,803 | 8/1953 | Andre | 46/25 |
| 3,034,254 | 5/1962 | Christiansen | 46/25 |
| 3,139,698 | 7/1964 | Arnold | 46/22 X |
| 3,191,937 | 6/1965 | Kropinski | 46/16 X |

FOREIGN PATENTS OR APPLICATIONS

| | | | |
|---|---|---|---|
| 1,547,162 | 10/1968 | France | 46/22 |
| 2,032,466 | 1/1972 | Germany | 46/25 |
| 1,042,412 | 9/1966 | United Kingdom | 46/25 |

*Primary Examiner*—F. Barry Shay
*Attorney, Agent, or Firm*—Stevens, Davis, Miller & Mosher

[57] ABSTRACT

As a supplement to toy building sets, which include elements having at least one inclined face, there is provided a toy building element of a similar kind, but wherein the inclined face is disposed in such a manner relatively to the top and bottom faces of the element that the buildng set comprising the previously known blocks (B) having an inclined face, and the blocks according to the invention (A) can be used for building a structure wherein the two kinds of blocks are combined, so as to provide inclined surface which are disposed symmetrically with respect to a horizontal plane.

2 Claims, 5 Drawing Figures

TOY BUILDING BLOCK FOR SUPPLEMENTING EXISTING BLOCK SETS

Figure 1:
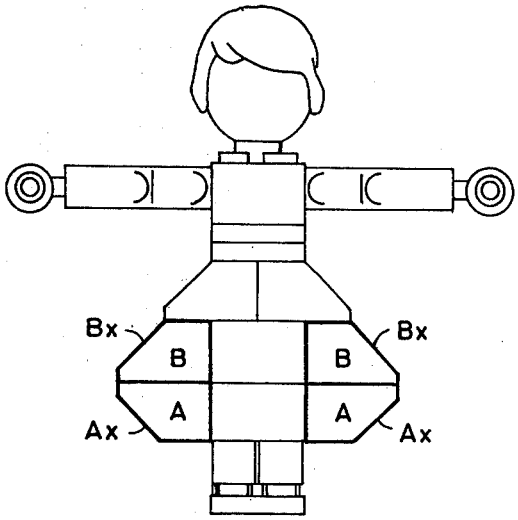

This invention relates to toy building blocks for building sets comprising a plurality of building elements made by injection moulding of a thermo-plastic material. Some of the said elements are made as toy building bricks or blocks comprising a hollow body open at one face and provided with at least one inclined face. These blocks are moreover provided with coupling means comprising projections extending from the faces of the blocks and adapted to engage protruding portions of an adjacent block when assembling such blocks for building a structure, such as a roof, wherein the inclined faces of adjacent blocks abutt so as to define the roof surface.

A building block of this kind is described in U.S. Pat. No. 3,034,254 and illustrated in FIGS. 5 and 7 thereof. (The same block is described in British Pat. No. 866,557 and the embodiment with which we are here concerned is shown in FIG. 12 thereof A building set comprising such blocks will enable the user to build structures including faces which are inclined relatively to a horizontal plane, but it cannot be used for making structures wherein two such surfaces are disposed symmetrically with respect to a horizontal plane.

It is the object of the present invention to modify the previously known block so as to provide a new block as an addition to the building set comprising the known blocks referred to whereby the use of the buildng set will be extended so as to enable the children to build structures including a pair of inclined surfaces disposed symmetrically with respect to a horizontal plane.

Figure 2:
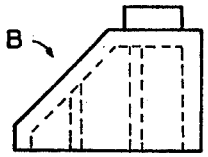
Figure 3:
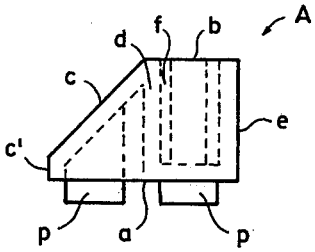
Figure 4:
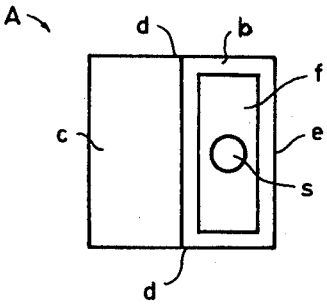
Figure 5:
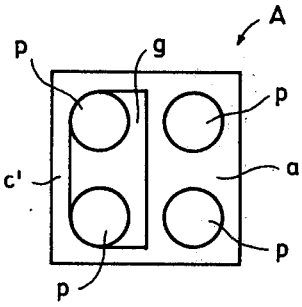

This object is achieved by the toy building blocks according to the present invention, the characteristic features of which will now be described with reference to the accompanying drawings:

In the drawings:

FIG. 1 is a front elevation showing a doll structure made partly by using the traditional blocks (B) having inclined faces (Bx) and partly by using blocks (A) according to the invention having inclined faces (Ax), FIG. 2 shows by way of comparison a front elevation of a known block (B) of the kind referred to above, FIG. 3 is a side elevation of a block according to the invention, FIG. 4 is a top view and FIG. 5 is a bottom view of the same block.

The figure shown in FIG. 1 is constructed partly from known elements, as indicated by a thin line, partly by elements A according to the invention, as indicated by a thick line, which are built together with known prismatic elements B of the type illustrated in FIG. 2. and also indicated by a thick line.

The figure of a doll, FIG. 1, shows how the inclined faces Ax and Bx of the joined elements A and B form together the contours of a dress or skirt which initially increases in width from the top and downwardly and then decreases in width towards the feet. Heretofore it has ot been possible to achieve such an effect by means of the conventional standard elements of a building set.

The element according to the invention shown in FIGS. 3 to 5 consists of a prismatic body obtained by resinous injection moulding comprising a bottom face *a*, a top face *b*, an inclined face *c*, a pair of trapezoid end faces *d* and a side face *e* at right angles to the bottom face *a* and the top face *b*.

The top face *b* is provided with a rectangular recess *f* extending proximate to the bottom face and in whose axis of symmetry there is formed a pin *s* (secondary projection) whose end face is flush with the plane of the top face.

The bottom face *a* is provided with four primary projections *p* symmetrically disposed about the center of the square and projecting from the plane of the bottom face. Two of said projections *p* are disposed in a recess *g* formed in the bottom face. The two recesses *f* and *g* provide for an appreciable saving in materials.

Coupling of the elements A and B, FIG. 1, and their joining with the other elements of the figure are effected in conventional manner by means of cooperating primary and secondary projections. For this purpose the width (diameter) ofthe primary projection *p* must equal the width of the recess *f*, and the width (diameter) of the secondary projection *s* must equal the spacing between the primary projections *p*. To avoid a sharp edge between the bottom face *a* and inclined face *c* there is provided between the latter a small rectangular side face *c'* at right angles to the bottom face *a*.

Although the invention has here been described with reference to the embodiment illustrated in the drawings wherein the block is provided with a square bottom face, it will be appreciated that the invention also comprises substantially similar elements wherein the bottom face is rectangular and comprises a multiple of squares as shown in FIG. 5 and the top face is extended so as to comprise the same multiple of the rectangular face *b* of FIG. 4.

What we claim is:

1. A toy building block having means for joining with other blocks of known design having complementary means, said block having a square face, a pair of opposing trapezoid end faces disposed at right angles to the bottom face, a rectangular side face disposed at right angles to the bottom face and the trapezoid end faces, a rectangular top face extending parallel to the bottom face, an inclined face extending from the top face towards the bottom face intermediate the trapezoid end faces, said joining means including four projections extending normally from said bottom face and disposed symmetrically with respect to the center of said square, a rectangular recess in the top face and a projection within said recess extending co-axially with the centre of said recess, the width of said projection being equal to the spacing between the projections in the bottom face and the width of the latter projections being equal to the width of the recess in the top face.

2. A toy building block as claimed in claim 1, said joining means further comprising a substantially rectangular recess in the bottom face, a pair of the projections of the bottom face remote from the topface and closest to the inclined face being disposed in a pair of corners of said bottom recess.

* * * * *

UNITED STATES PATENT AND TRADEMARK OFFICE

CERTIFICATE OF CORRECTION

PATENT NO. : 4,028,844

DATED : June 14, 1977

INVENTOR(S) : Erling Thue DIDERIKSEN et al

It is certified that error appears in the above-identified patent and that said Letters Patent are hereby corrected as shown below:

Column 1, line 22, after "thereof" insert -- ). --;

Column 1, line 63, change "ot" to -- not --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*